US007113602B2

(12) United States Patent
Oinoue et al.

(10) Patent No.: US 7,113,602 B2
(45) Date of Patent: Sep. 26, 2006

(54) APPARATUS FOR ADJUSTABLE POSITIONING OF VIRTUAL SOUND SOURCE

(75) Inventors: Hiroshi Oinoue, Tokyo (JP); Shinichi Maru, Chiba (JP); Junichi Usui, Saitama (JP); Toshihiko Konno, Tokyo (JP)

(73) Assignee: Sony Corporation, Tokyo (JP)

( * ) Notice: Subject to any disclaimer, the term of this patent is extended or adjusted under 35 U.S.C. 154(b) by 676 days.

(21) Appl. No.: 09/884,207

(22) Filed: Jun. 19, 2001

(65) Prior Publication Data

US 2002/0031231 A1 Mar. 14, 2002

(30) Foreign Application Priority Data

Jun. 21, 2000 (JP) ..... 2000-186619

(51) Int. Cl.
*H04R 5/02* (2006.01)

(52) U.S. Cl. ..... 381/17; 381/86; 381/310

(58) Field of Classification Search ..... 381/1, 381/63, 61, 17, 86, 162, 101, 102, 310
See application file for complete search history.

(56) References Cited

U.S. PATENT DOCUMENTS 4,438,414 A * 3/1984 Blachot ..... 333/28 T
4,622,691 A * 11/1986 Tokumo et al. ..... 381/86
4,980,914 A * 12/1990 Kunugi et al. ..... 381/1
5,850,453 A * 12/1998 Klayman et al. ..... 381/1
6,108,430 A * 8/2000 Kurisu ..... 381/310
2001/0031054 A1* 10/2001 Grimani ..... 381/98

* cited by examiner

*Primary Examiner*—Daniel Swerdlow
(74) *Attorney, Agent, or Firm*—Finnegan, Henderson, Farabow, Garrett & Dunner, L.L.P.

(57) ABSTRACT

An acoustic apparatus comprises an attenuator for attenuating a first audio signal to produce a second audio signal, a low pass filter for reducing high frequency components of the second audio signal to produce a third audio signal, a differential amplifier operative to produce a fourth audio signal corresponding to a difference between the first and third audio signals, and a speaker supplied with the fourth audio signal obtained from the differential amplifier, wherein a cutoff frequency of the low pass filter is selected to be not lower than 2 kHz and not higher than 6 kHz and attenuation of the first audio signal in the attenuator is so selected that a listener is able to recognize a virtual sound source position in front of and at a level higher than an actual position of the speaker.

4 Claims, 5 Drawing Sheets

SLX(SRX)

APPARATUS FOR ADJUSTABLE POSITIONING OF VIRTUAL SOUND SOURCE

BACKGROUND OF THE INVENTION

1. Field of the Invention

The present invention relates generally to acoustic apparatus, and more particularly, to an apparatus for providing an audio signal with predetermined signal processing to be supplied to a speaker so that reproduced sound based on the audio signal is obtained from the speaker functioning as a sound source.

2. Description of the Prior Art

There have been proposed various kinds of acoustic apparatus operative to reproduce sound based on an audio signal. When reproduced sound representing music, speech or the like is obtained by one or more of the acoustic apparatus to be heard by a listener, it is generally desired that a sound source generating the reproduced sound is positioned in front of the listener. This is easily understood in view of the ordinary fact that a listener tends naturally to take his or her position to face a sound source in a limited sound field, such as a space in a hall or the like, if it is unnecessary for the listener to move with the intention of some particular purpose or to be particularly restricted in position or direction of his or her face in the limited sound field.

Accordingly, for example, in the case where sound reproduced by a speaker or plural speakers which are supplied with audio signals is appreciated, such a layout that listeners are positioned to face the speaker functioning as a sound source or a main one of the plural speakers is established. With the layout thus established, each of the listeners can be mentally composed and stabilized.

Further, it is also desired that the sound source generating the reproduced sound is positioned at a listener's eye level in height. That is, in a positional relation in height between the sound source and the listener, the sound source positioned at listener's eye level contributes to causing the listener to be mentally composed and stabilized.

Under the situation mentioned above, when reproduced sound is obtained from a speaker or plural speakers provided for one or more acoustic apparatus to be heard by a listener, a condition wherein the listener is restricted in position, direction of his or her face, posture and so on is often brought about. In such a case, the listener is compelled to be put in a condition wherein the speaker functioning as a sound source is not positioned in front of the listener or is positioned at a level in height apparently different from a listener's eye level.

For example, in the case where sound reproduced by an acoustic apparatus employed in a vehicle (hereinafter, referred to an acoustic apparatus for vehicles) is enjoyed in a cabin of the vehicle, a listener, namely, a driver or other passenger of the vehicle who keeps usually his or her posture to sit down on a seat in the cabin is basically restricted in position, direction of his or her face, posture and so on to listen to the reproduced sound even though the seat is adjustable to some degree in its position and direction. In such a case, since the vehicle is usually furnished with various kinds of equipments each occupying a space limited at maximum in the cabin, a main portion of the acoustic apparatus for vehicles is often provided on a dashboard or a console shelf forming a front end portion of the cabin and speakers connected electrically with the main portion of the acoustic apparatus for vehicles are provided, for example, in lower portions of left and right doors attached to left and right side portions of a body of the vehicle, respectively.

The speakers thus provided in the lower portions of the left and right doors, respectively, are positioned neither in front of the driver or other passenger nor at the eye level of the driver or other passenger. Therefore, the driver or other passenger is compelled to listen to the reproduced sound from the speakers each functioning as a sound source, each of which is positioned at the left to right side or at the back of the driver or other passenger and at a level in height apparently different from the eye level of the driver or other passenger.

There has been previously proposed an improved acoustic system with which one or more speakers function as actual sound sources for generating reproduced sound and a listener can listen to the reproduced sound as if the reproduced sound is obtained from a position different from the positions of the speakers, for example, in front of the listener, in other words, the listener can recognize a virtual sound source at the position different from the positions of the speakers, as shown in, for example, Japanese patent laid-open publication No. HEI 5-316599. It would be possible to solve the aforementioned problems relative to the acoustic apparatus for vehicles if such an improved acoustic system as described above could be favorably applied to the acoustic apparatus for vehicles.

However, it is necessary to provide a circuit structure containing a compensating filter, a filter characteristic of which must be selectable, for causing audio signals to be subjected to predetermined signal processing and then to be supplied to the speakers when the aforementioned proposal of the improved acoustic system is intended to be put into practice and the circuit structure which contains the compensating filter to be provided for putting the improved acoustic system into practice brings about enlargement in scale of the circuit structure and considerable increase in cost. Accordingly, it seems to be quite difficult to apply favorably the improved acoustic system proposed previously to the acoustic apparatus for vehicles.

OBJECTS AND SUMMARY OF THE INVENTION

Accordingly, it is an object of the present invention to provide an acoustic apparatus for providing an audio signal with predetermined signal processing to be supplied to a speaker so that reproduced sound based on the audio signal is obtained from the speaker, which avoids the aforementioned problems and disadvantages encountered with the prior art.

Another object of the present invention is to provide an acoustic apparatus for providing an audio signal with predetermined signal processing to be supplied to a speaker so that reproduced sound based on the audio signal is obtained from the speaker, which can cause a listener who intends to listen the reproduced sound to recognize a virtual sound source position in front of and at a level higher than an actual position of the speaker with a circuit structure simplified in construction and avoiding or restricting increase in cost.

A further object of the present invention is to provide an acoustic apparatus for providing an audio signal with predetermined signal processing to be supplied to a speaker so that reproduced sound based on the audio signal is obtained from the speaker, which can cause a listener who intends to listen the reproduced sound to recognize a virtual sound source position in front of and at a level higher than an actual position of the speaker with a circuit structure simplified in construction and avoiding or restricting increase in cost and therefore is suitable to be employed in a vehicle as an acoustic apparatus for vehicles.

According to the present invention, there is provided an acoustic apparatus comprising an attenuator portion for attenuating a first audio signal supplied thereto to produce a second audio signal, a low pass filter portion for reducing high frequency components of the second audio signal obtained from the attenuator portion to produce a third audio signal, a differential amplifier portion operative to produce a fourth audio signal corresponding to a difference between the first and third audio signals supplier thereto, and a speaker portion supplied with the fourth audio signal obtained from the differential amplifier portion, wherein a cutoff frequency of the low pass filter portion is selected to be not lower than 2 kHz and not higher than 6 kHz and attenuation of the first audio signal in the attenuator portion is so selected that a listener who intends to listen to reproduced sound obtained from the speaker portion is able to recognize a virtual sound source position in front of and at a level higher than an actual position of the speaker portion.

In one embodiment of acoustic apparatus according to the present invention, the attenuator portion is provided for attenuating each of left and right channel signals forming a stereo audio signal and supplied thereto as the first audio signal to produce the second audio signal containing the attenuated left and right channel signals, the low pass filter portion is provided for reducing high frequency components of each of the attenuated left and right channel signals contained in the second audio signal to produce the third audio signal containing the left and right channel signals each reduced in its high frequency components, the differential amplifier portion is provided to be operative to produce the fourth audio signal containing a left channel difference signal corresponding to a difference between the left channel signal contained in the first audio signal and the left channel signal reduced in its high frequency components and contained in the third audio signal and a right channel difference signal corresponding to a difference between the right channel signal contained in the first audio signal and the right channel signal reduced in its high frequency components and contained in the third audio signal, and the speaker portion is provided to include a left speaker supplied with the left channel difference signal contained in the fourth audio signal and a right speaker supplied with the right channel difference signal contained in the fourth audio signal. Then, in this embodiment of acoustic apparatus according to the present invention, attenuation of the left channel signal and attenuation of the right channel signal in the attenuator portion are so selected that the listener is able to recognize a virtual left sound source position in front of and at a level higher than an actual position of the left speaker and a virtual right sound source position in front of and at a level higher than an actual position of the right speaker.

In the acoustic apparatus thus constituted in accordance with the present invention, the reproduced sound based on the first audio signal is obtained from the speaker portion to which the fourth audio signal is supplied, and with the cutoff frequency of the low pass filter portion selected to be not lower than 2 kHz and not higher than 6 kHz and the selected attenuation of the first audio signal in the attenuator portion, a condition in which the listener is able to recognize the virtual sound source position in front of and at the level higher than the actual position of the speaker portion is brought about.

Such a condition that the listener is able to recognize the virtual sound source position in front of and at the level higher than the actual position of the speaker portion is obtained with a circuit structure which includes the attenuator portion for attenuating the first audio signal supplied thereto, the low pass filter portion for reducing high frequency components of the second audio signal obtained from the attenuator portion and the differential amplifier portion operative to produce the fourth audio signal corresponding to the difference between the first and third audio signals supplier thereto, in addition of the speaker portion supplied with the fourth audio signal. This circuit structure is relatively simplified in construction and able to avoid or restrict increase in cost.

Accordingly, with the acoustic apparatus according to the present invention, when the first audio signal is provided with the predetermined signal processing and the fourth audio signal is produced to be supplied to the speaker portion so that the reproduced sound based on the first audio signal is obtained from the speaker, a condition in which the listener who intends to listen the reproduced sound obtained from the speaker portion is able to recognize the virtual sound source position in front of and at the level higher than the actual position of the speaker portion is brought about with the circuit structure simplified in construction and avoiding or restricting increase in cost. Consequently, the acoustic apparatus according to the present invention is suitable to be employed in a vehicle as an acoustic apparatus for vehicles.

Especially, in one embodiment of acoustic apparatus according to the present invention, the first audio signal is selected to be the stereo audio signal containing the left and right channel signals and the speaker portion is provided to include the left and right speakers, and therefore a condition in which the listener is able to recognize the virtual left sound source position in front of and at the level higher than the actual position of the left speaker and recognize also the virtual right sound source position in front of and at the level higher than the actual position of the right speaker is brought about with the circuit structure including the attenuator portion, the low pass filter portion and the differential amplifier portion, which is simplified in construction and able to avoid or restrict increase in cost.

The above, and other objects, features and advantages of the present invention will become apparent from the following detailed description which is to be read in conjunction with the accompanying drawings.

DESCRIPTION OF THE PREFERRED EMBODIMENTS

The invention will now be described by way of example with reference to the accompanying drawings.

Figure 1:
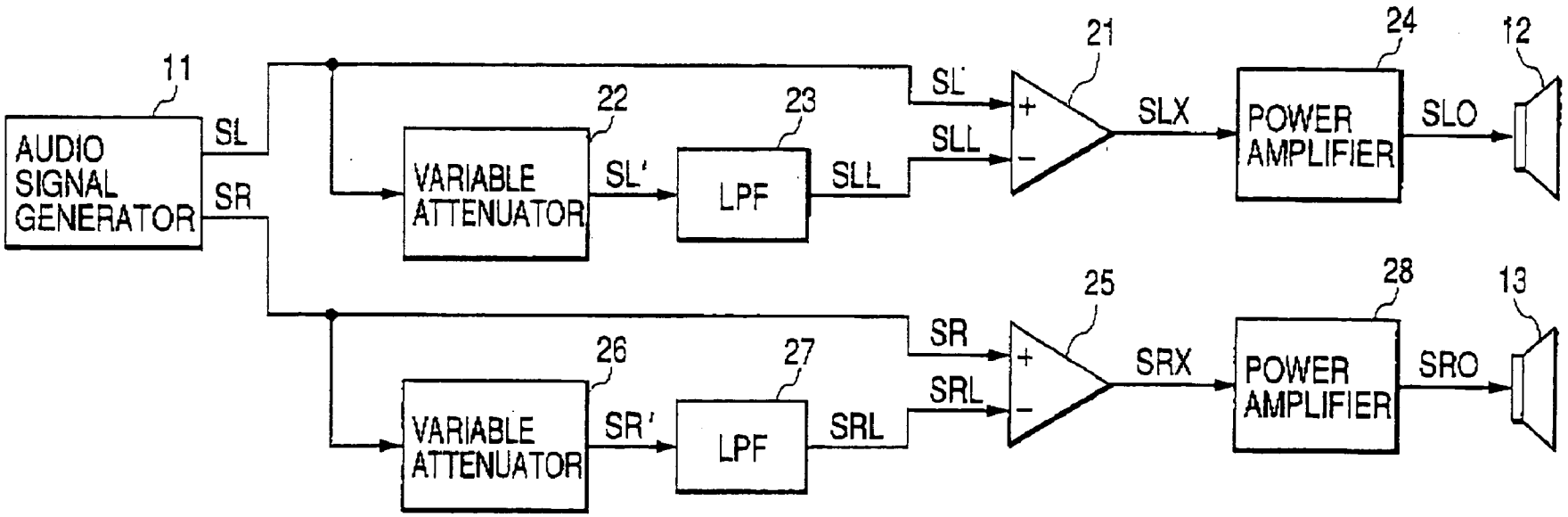
FIG. 1 is a schematic block diagram showing one embodiment of acoustic apparatus according to the present invention.

FIG. 1 shows an embodiment of acoustic apparatus according to the present invention.

Referring to FIG. 1, the embodiment shown in FIG. 1 constitutes an acoustic apparatus for vehicle which is operative to obtain reproduced sound based on a stereo audio signal containing left and right channel signals. Therefore, the embodiment shown in FIG. 1 is provided with an audio signal generator 11 for generating a stereo audio signal (a first audio signal) containing a left channel signal SL and a right channel signal SR, and a speaker portion including a left speaker 12 for reproducing sound based on the left channel signal SL and a right speaker 13 for reproducing sound based on the right channel signal SR.

Figure 2:
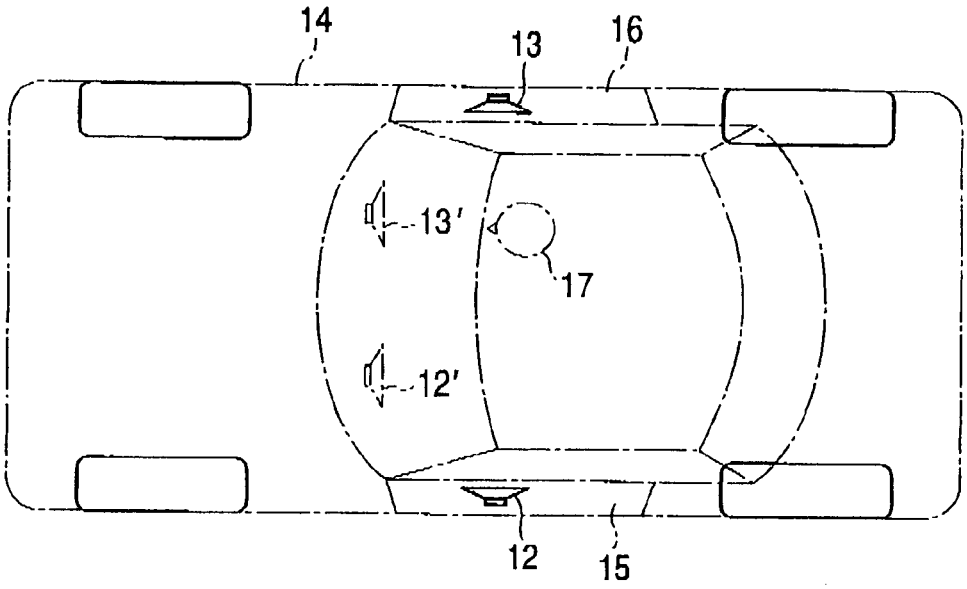
FIGS. 2 and 3 are schematic illustrations used for explaining positions of left and right speakers and positions of virtual left and right sound sources in the embodiment show in FIG. 1.
Figure 3:
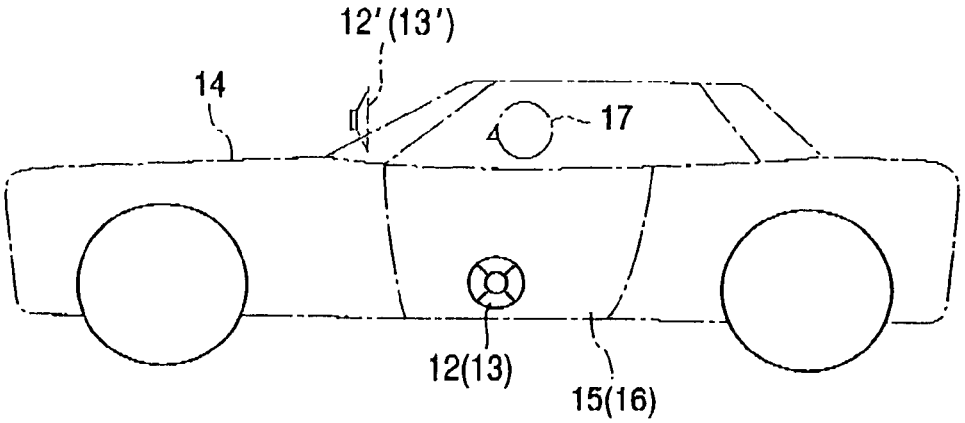

The left and right speakers 12 and 13 are provided, for example, in lower portions of left and right doors 15 and 16 which are attached to a body 14 of a vehicle, respectively, as shown in FIGS. 2 and 3. The left speaker 12 thus provided is positioned at the left side of a driver 17 sit down on a driver's seat of the vehicle, who is a listener listening to the reproduced sound obtained from the left and right speakers 12 and 13, and at a level positively lower than the eye level of the driver 17. The right speaker 13 provided in such a manner as described above is positioned at the right side of the driver 17 sit down on the driver's seat of the vehicle and at a level positively lower than the eye level of the driver 17.

The left channel signal SL obtained from the audio signal generator 11 is supplied to one of a pair of input terminals of a differential amplifier 21 (differential amplifier means) and a variable attenuator 22 (variable attenuator means). The variable attenuator 22 is operative to attenuate the left channel signal SL to a predetermined attenuated level for producing an attenuated left channel signal SL' (a second audio signal) to be supplied to a low pass filter (LPF) 23 (low pass filter means).

A cutoff frequency (fc) of the LPF 23 is selected to be not lower than 2 kHz and not higher than 6 kHz, for example, about 4 kHz. The LPF 23 is operative to reduce high frequency components, for example, frequency components equal to or higher than 4 kHz of the attenuated left channel signal SL' for producing a left channel signal SLL (a third audio signal) with reduced high frequency components to be supplied to the other of the pair of input terminals of the differential amplifier 21.

The differential amplifier 21 is operative to detect a difference between the left channel signal SL obtained from the audio signal generator 11 and the left channel signal SLL with reduced high frequency components obtained from the LPF 23 by means of operation for subtracting the left channel signal SLL from the left channel signal SL for producing a left channel difference signal SLX (a fourth audio signal) corresponding to the difference between the left channel signal SL and the left channel signal SLL to be supplied to a power amplifier 24.

Figure 4:
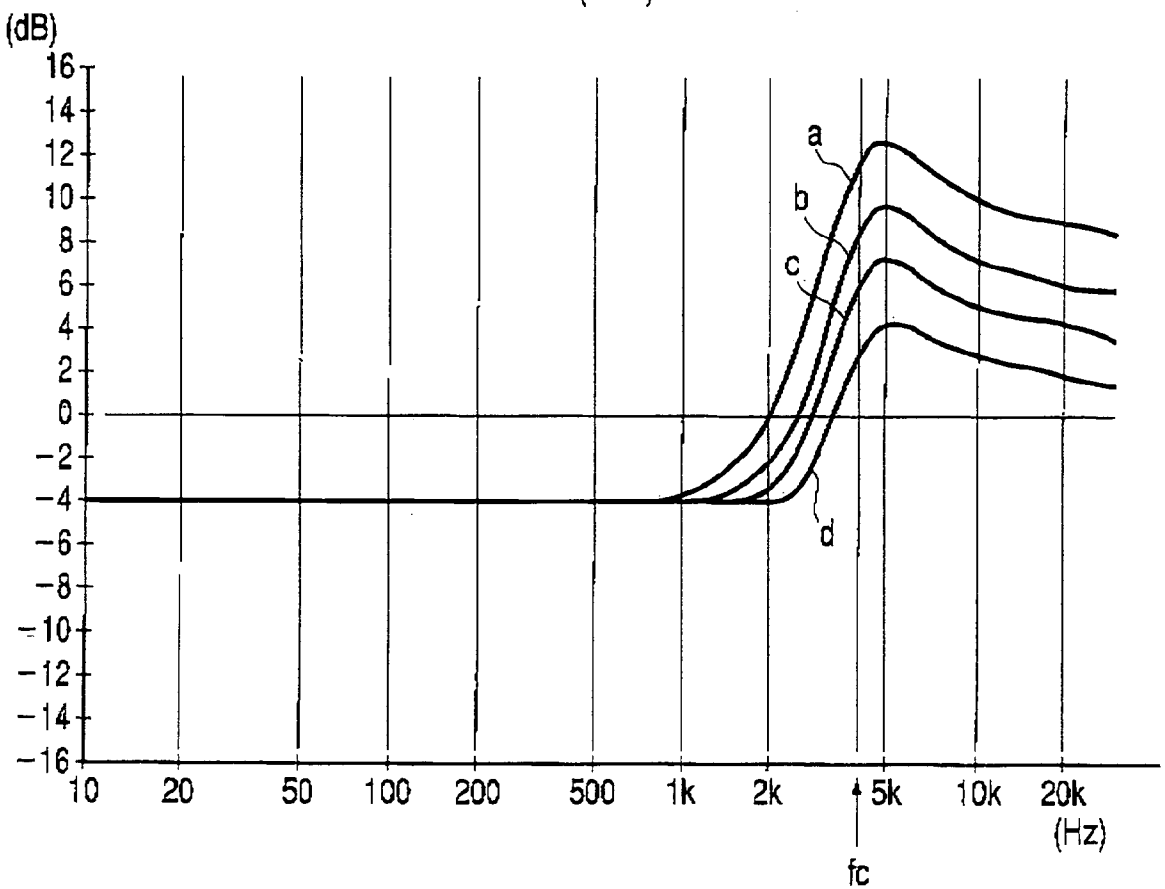
FIG. 4 is a characteristic diagram used for explaining the embodiment shown in FIG. 1.

The left channel difference signal SLX thus obtained from the differential amplifier 21 has a level-frequency characteristic represented by, for example, a curve a, b, c or d shown in a characteristic diagram of FIG. 4, in which a gain of a high frequency band portion is larger than that of a low frequency band portion. The curve a, b, c and d shown in the characteristic diagram of FIG. 4 are obtained in response to degrees of attenuation of the left channel signal SL in the variable attenuator 22. Such a change as to shift sequentially from the curve a to the curve b, the curve c and the curve d is brought about in response to increase in the degree of attenuation of the left channel signal SL in the variable attenuator 22.

The power amplifier 24 is operative to amplify the left channel difference signal SLX in power for producing an amplified left channel difference signal SLO to be supplied to the left speaker 12 and thereby reproduced sound responding to the amplified left channel difference signal SLO, namely, reproduced sound based on the left channel signal SL is obtained from the left speaker 12.

Meanwhile, the right channel signal SR obtained from the audio signal generator 11 is supplied to one of a pair of input terminals of a differential amplifier 25 (differential amplifier means) and a variable attenuator 26 (variable attenuator means). The variable attenuator 26 is operative to attenuate the right channel signal SR to a predetermined attenuated level for producing an attenuated right channel signal SR' (a second audio signal) to be supplied to a low pass filter (LPF) 27 (low pass filter means).

A cutoff frequency of the LPF 27 is also selected to be not lower than 2 kHz and not higher than 6 kHz, for example, about 4 kHz. The LPF 27 is operative to reduce high frequency components, for example, frequency components equal to or higher than 4 kHz of the attenuated right channel signal SR' for producing a right channel signal SRL (a third audio signal) with reduced high frequency components to be supplied to the other of the pair of input terminals of the differential amplifier 25.

The differential amplifier 25 is operative to detect a difference between the right channel signal SR obtained from the audio signal generator 11 and the right channel signal SRL with reduced high frequency components obtained from the LPF 27 by means of operation for subtracting the right channel signal SRL from the right channel signal SR for producing a right channel difference signal SRX (a fourth audio signal) corresponding to the difference between the right channel signal SR and the right channel signal SRL to be supplied to a power amplifier 28.

The right channel difference signal SRX thus obtained from the differential amplifier 28 has also a level-frequency characteristic represented by, for example, the curve a, b, c or d shown in the characteristic diagram of FIG. 4, in which the gain of the high frequency band portion is larger than that of the low frequency band portion. The curve a, b, c and d shown in the characteristic diagram of FIG. 4 are obtained in response to degrees of attenuation of the right channel signal SR in the variable attenuator 26. Such a change as to shift sequentially from the curve a to the curve b, the curve c and the curve d is brought about in response to increase in the degree of attenuation of the right channel signal SR in the variable attenuator 26.

The power amplifier 28 is operative to amplify the right channel difference signal SRX in power for producing an amplified right channel difference signal SRO to be supplied to the right speaker 13 and thereby reproduced sound responding to the amplified right channel difference signal SRO, namely, reproduced sound based on the right channel signal SR is obtained from the right speaker 13.

Since the left channel difference signal SLX has the level-frequency characteristic represented by, for example, the curve a, b, c or d shown in the characteristic diagram of FIG. 4, in which the gain of the high frequency band portion is larger than that of the low frequency band portion, as described above, a condition in which the listener listening to the reproduced sound obtained from the left and right speakers 12 and 13, for example, the driver 17 listens to the reproduced sound from the left speaker 12 as if the reproduced sound is obtained from a virtual left sound source positioned in front of and at a level higher than the actual position of the left speaker 12 as shown in FIGS. 2 and 3 is set. In other words, such a condition that the listener listening to the reproduced sound obtained from the left and right speakers 12 and 13, for example, the driver 17 is able to recognize a virtual left sound source position 12' in front of and at the level higher than the actual position of the left speaker 12 as shown in FIGS. 2 and 3 is established.

The virtual left sound source position 12' recognized by the listener, such as the driver 17, can be determined by setting the degree of attenuation of the left channel signal SL in the variable attenuator 22 to be, for example, in front of the left side of the driver 17 and at almost the eye level of the driver 17 so as to float over the dashboard of the vehicle as shown in FIGS. 2 and 3. The virtual left sound source position 12' can be easily adjusted, especially in height, by changing the degree of attenuation of the left channel signal SL in the variable attenuator 22.

Further, since the right channel difference signal SRX has also the level-frequency characteristic represented by, for example, the curve a, b, c or d shown in the characteristic diagram of FIG. 4, in which the gain of the high frequency band portion is larger than that of the low frequency band portion, as described above, a condition in which the listener listening to the reproduced sound obtained from the left and right speakers 12 and 13, for example, the driver 17 listens to the reproduced sound from the right speaker 13 as if the reproduced sound is obtained from a virtual right sound source positioned in front of and at a level higher than the actual position of the right speaker 13 as shown in FIGS. 2 and 3 is set. In other words, such a condition that the listener listening to the reproduced sound obtained from the left and right speakers 12 and 13, for example, the driver 17 is able to recognize a virtual right sound source position 13' in front of and at the level higher than the actual position of the right speaker 13 as shown in FIGS. 2 and 3 is established.

The virtual right sound source position 13' recognized by the listener, such as the driver 17, can be determined by setting the degree of attenuation of the right channel signal SR in the variable attenuator 26 to be, for example, in front of the right side of the driver 17 and at almost the eye level of the driver 17 so as to float over the dashboard of the vehicle as shown in FIGS. 2 and 3. The virtual right sound source position 13' can be easily adjusted, especially in height, by changing the degree of attenuation of the right channel signal SR in the variable attenuator 26.

As described above, in the embodiment shown in FIG. 1, under a situation wherein the left and right speakers 12 and 13 are actually provided respectively on the left and right sides of the driver 17 sit down on the driver's seat of the vehicle to be the listener listening to the reproduced sound obtained from the left and right speakers 12 and 13 and at the level positively lower than the eye level of the driver 17, the condition in which the driver 17 who is the listener listening to the reproduced sound obtained from the left and right speakers 12 and 13 is able to recognize the virtual left and right sound source positions 12' and 13' in front of and at the level higher than the actual positions of the left and right speakers 12 and 13 as shown in FIGS. 2 and 3 is established by means of selecting the cutoff frequency of each of the LPFs 23 and 27 to be not lower than 2 kHz and not higher than 6 kHz, for example, about 4 kHz and adjusting each of the variable attenuators 22 and 26 to attenuate the left or right channel signal SL or SR to the predetermined attenuated level.

In such a case, the attenuation of the left channel signal SL in the variable attenuator 22 is so selected that the amplified left channel difference signal SLO supplied to the left speaker 12 is represented with an equation Eq-1 mentioned below and the attenuation of the right channel signal SR in the variable attenuator 26 is so selected that the amplified right channel difference signal SRO supplied to the right speaker 13 is represented with an equation Eq-2 mentioned below.

$$SLO=(L\times ARR(z)-R\times ARL(z))/(ALL(z)\times ARR(z)-ALR(z)\times ARL(z)) \quad \text{Eq-1}$$

$$SRO=(R\times ALL(z)-L\times ALR(z))/(ALL(z)\times ARR(z)-ALR(z)\times ARL(z)) \quad \text{Eq-2}$$

In the equations Eq-1 and Eq-2, the following equations Eq-3 and Eq-4 are satisfied.

$$L=SL\times BLL(z)+SR\times BRL(z) \quad \text{Eq-3}$$

$$R=SL\times BLR(z)+SR\times BRR(z) \quad \text{Eq-4}$$

The following definitions are applied to the equations Eq-1, Eq-2, Eq-3 and Eq-4.

SL: Left channel signal

SR: Right channel signal

Figure 5:
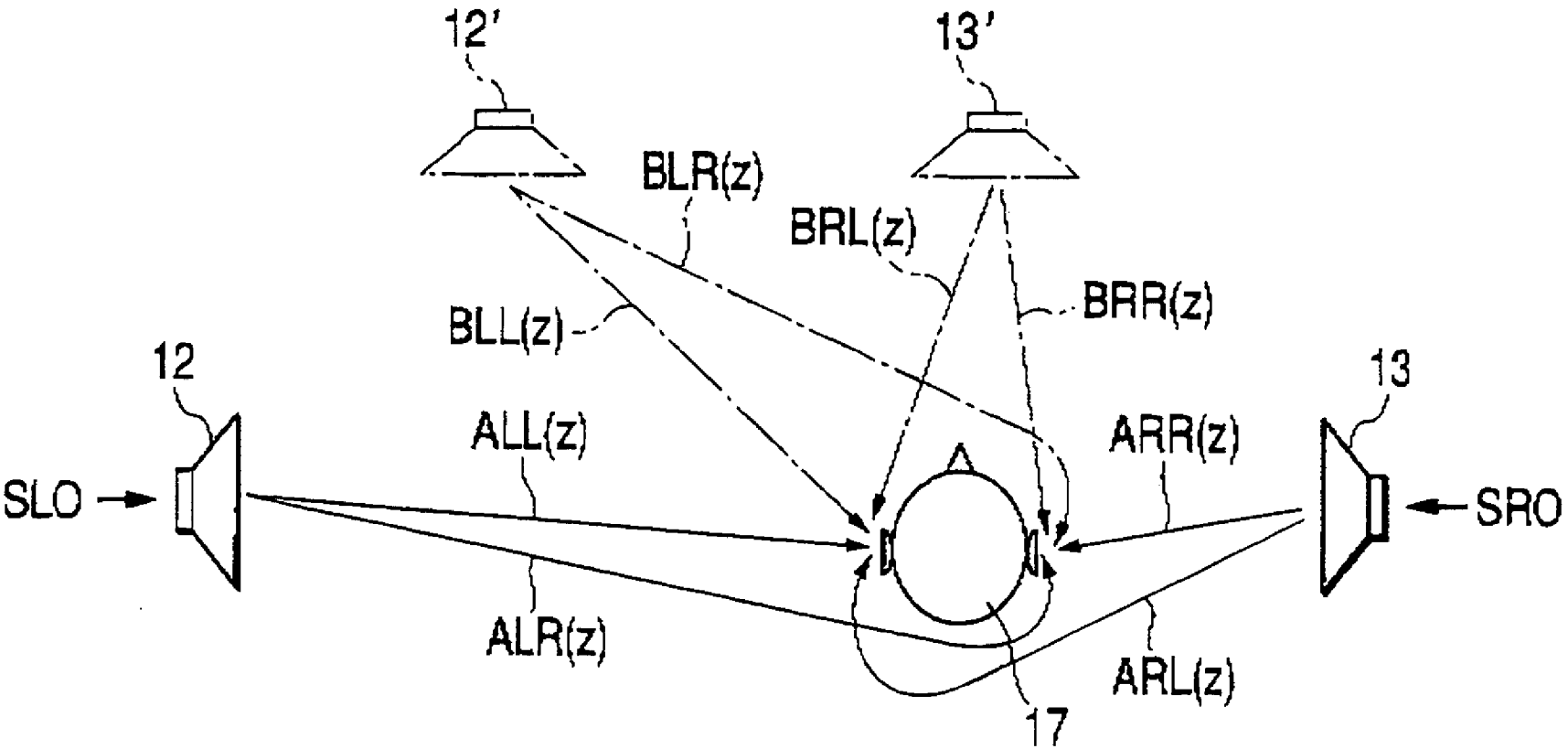
FIG. 5 is a schematic illustration used for explaining the embodiment shown in FIG. 1.

ALL(z): Acoustic transfer function from the left speaker 12 to a left ear of the driver 17 as the listener as shown in FIG. 5.

ALR(z): Acoustic transfer function from the left speaker 12 to a right ear of the driver 17 as the listener as shown in FIG. 5.

ARL(z): Acoustic transfer function from the right speaker 13 to the left ear of the driver 17 as the listener as shown in FIG. 5.

ARR(z): Acoustic transfer function from the right speaker 13 to the right ear of the driver 17 as the listener as shown in FIG. 5.

BLL(z): Acoustic transfer function from the virtual left sound source position 12' to the left ear of the driver 17 as the listener as shown in FIG. 5.

BLR(z): Acoustic transfer function from the virtual left sound source position 12' to the right ear of the driver 17 as the listener as shown in FIG. 5.

BRL(z): Acoustic transfer function from the virtual right sound source position 13' to the left ear of the driver 17 as the listener as shown in FIG. 5.

BRR(z): Acoustic transfer function from the virtual right sound source position 13' to the right ear of the driver 17 as the listener as shown in FIG. 5.

With the attenuation of the left channel signal SL in the variable attenuator 22 and the attenuation of the right channel signal SR in the variable attenuator 26 selected in the manner as mentioned above, the driver 17 who is the listener listening to the reproduced sound obtained from the left and right speakers 12 and 13 is able to recognize the virtual left and right sound source positions 12' and 13' in front of and at the level higher than the actual positions of the left and right speakers 12 and 13 under the situation wherein the left and right speakers 12 and 13 are actually provided respectively on the left and right sides of the driver 17 sit down on the driver's seat of the vehicle and at the level positively lower than the eye level of the driver 17. The virtual left and right sound source positions 12' and 13' recognized by the driver 17 can be adjusted by changing the attenuation of the left channel signal SL in the variable attenuator 22 and the attenuation of the right channel signal SR in the variable attenuator 26, respectively. Especially, each of the virtual left and right sound source positions 12' and 13' can be easily adjusted in height.

Figure 6:
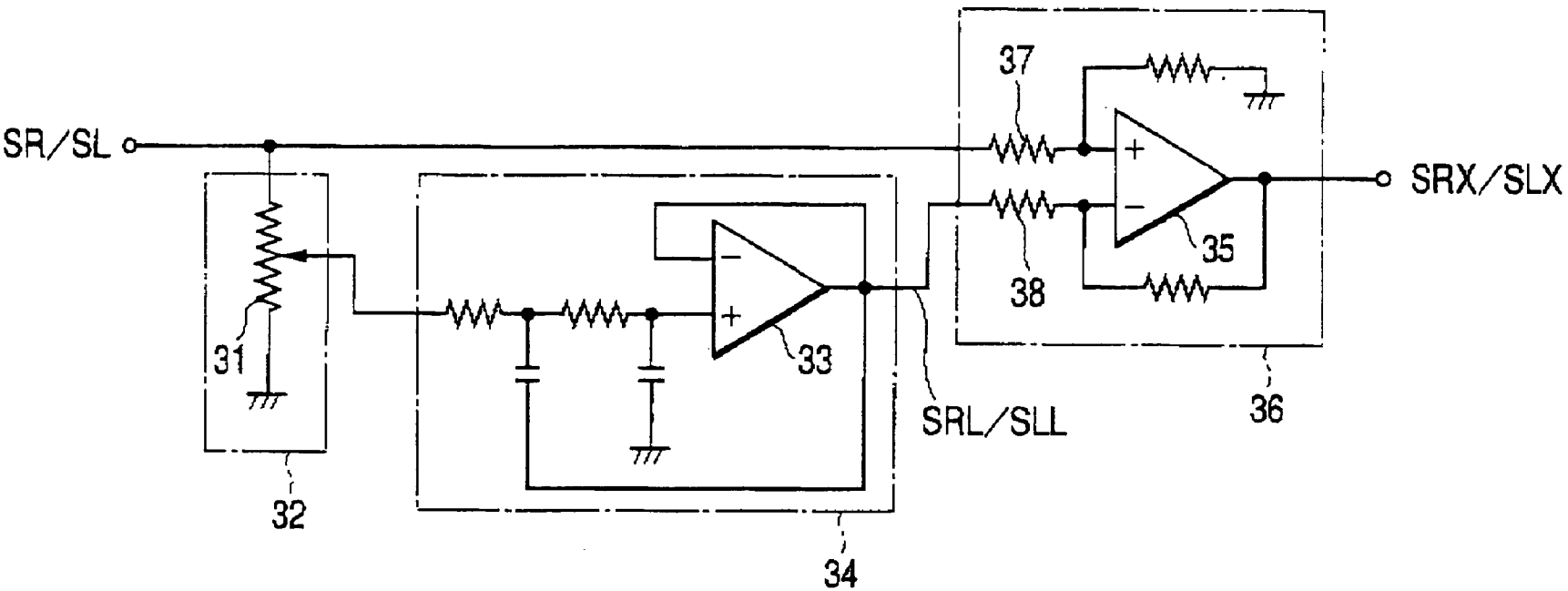
FIG. 6 is an embodied circuit diagram showing a portion of the embodiment shown in FIG. 1, which includes a variable attenuator, a low pass filter and a differential amplifier.

FIG. 6 shows an embodied circuit diagram of a portion of the embodiment shown in FIG. 1, which includes the variable attenuator 22, the LPF 23 and the differential amplifier 21 or a portion of the embodiment shown in FIG. 1, which includes the variable attenuator 26, the LPF 27 and the differential amplifier 25.

In the embodied circuit diagram shown in FIG. 6, a portion 32 containing a variable resistor 31 constitutes the variable attenuator 22 or 26, a portion 34 containing an operation amplifier 33 constitutes the LPF 23 or 27, and a portion 36 containing an operation amplifier 35 constitutes the differential amplifier 21 or 25. In the portion 36, the difference between the left channel signal SL and the left channel signal SLL or the difference between the right channel signal SR and the right channel signal SRL can be changed by changing a ratio of resistance of a resistor 37 through which the left channel signal SL or the right channel signal SR is supplied to one of a pair of input terminals of the operation amplifier 35 to resistance of a resistor 38 through which the left channel signal SLL or the right channel signal SRL is supplied to the other of the pair of input terminals of the operation amplifier 35. Accordingly, the virtual left sound source position 12' or the virtual right sound source position 13' can be adjusted in height, for example, by changing the ratio of the resistance of the resistor 37 to the resistance of the resistor 38, in the same manner as changing the attenuation of the left channel signal SL in the variable attenuator 22 or the attenuation of the right channel signal SR in the variable attenuator 26.

Each of the portion of the embodiment shown in FIG. 1, which includes the variable attenuator 22, the LPF 23 and the differential amplifier 21 and the portion of the embodiment shown in FIG. 1, which includes the variable attenuator 26, the LPF 27 and the differential amplifier 25, is relatively simplified in construction and obtained at low cost. Consequently, in the embodiment shown in FIG. 1, the condition in which the driver 17 who is the listener listening to the reproduced sound obtained from the left and right speakers 12 and 13 can recognize the virtual left and right sound source positions 12' and 13' in front of and at the level higher than the actual positions of the left and right speakers 12 and 13 is established with a circuit structure containing the variable attenuators 22 and 26, the LPFs 23 and 27, and the differential amplifiers 21 and 25, which is relatively simplified in construction and able to avoid or restrict increase in cost.

Although the embodiment shown in FIG. 1 constitutes the acoustic apparatus for vehicle which is operative to obtain the reproduced sound based on the stereo audio signal containing the left and right channel signals SL and SR, the acoustic apparatus according to the present invention should not be limited to the apparatus for obtaining reproduced sound based on the stereo audio signal but may be constituted with an attenuator, a LPF and a differential amplifier for handling a monaural audio signal. Further, the acoustic apparatus according to the present invention is not always required to constitute the acoustic apparatus for vehicle but may be formed into various apparatus other than the acoustic apparatus for vehicle.

What is claimed is:

1. An acoustic apparatus comprising;

attenuator means for attenuating a first audio signal supplied thereto to produce a second audio signal, low pass filter means for reducing high frequency components of the second audio signal obtained from the attenuator means to produce a third audio signal, differential amplifier means operative to produce a fourth audio signal corresponding to a difference between the first and third audio signals supplier thereto, and speaker means supplied with the fourth audio signal obtained from the differential amplifier means, wherein said attenuator means is provided for attenuating each of left and right channel signals of the first audio signal to produce the second audio signal containing the attenuated left and right channel signals, and said speaker means includes a left speaker supplied with the left channel difference signal contained in the fourth audio signal and a right speaker supplied with the right channel difference signal contained in the fourth audio signal, and the attenuator means is operative to create a virtual left sound source position in front of and at a level higher than an actual position of the left speaker and a virtual right sound source position in front of and at a level higher than an actual position of the right speaker, and wherein said attenuator means is operative to determine the attenuation of each of the left and right channel signals so that the following equations are satisfied:

$$SLO=(L\times ARR(z)-R\times ARL(z))/(ALL(z)\times ARR(z)-ALR(z)\times ARL(z))$$

$$SRO=(R\times ALL(z)-L\times ALR(z))/(ALL(z)\times ARR(z)-ALR(z)\times ARL(z))$$

$$L=SL\times BLL(z)+SR\times BRL(z)$$

$$R=SL\times BLR(z)+SR\times BRR(z)$$

wherein

SLO represents the amplified left channel difference signal,

SRO represents the amplified right channel difference signal,

SL represents the left channel signal,

SR represents the right channel signal,

ALL(z) represents an acoustic transfer function from the left speaker to a left ear of the listener, ALR(z) represents an acoustic transfer function from the left speaker to a right ear of the listener, ARL(z) represents an acoustic transfer function from the right speaker to the left ear of the listener, ARR(z) represents an acoustic transfer function from the right speaker to the right ear of the listener, BLL(z) represents an acoustic transfer function from the virtual left sound source position to the left ear of the listener, BLR(z) represents an acoustic transfer function from the virtual left sound source position to the right ear of the listener, BRL(z) represents an acoustic transfer function from the virtual right sound source position to the left ear of the listener, and BRR(z) represents an acoustic transfer function from the virtual right sound source position to the right ear of the listener.

2. An acoustic apparatus according to claim 1, wherein said low pass filter means is provided for reducing high frequency components of each of the attenuated left and right channel signals contained in the second audio signal to produce the third audio signal containing the left and right channel signals each reduced in its high frequency components, said differential amplifier means is provided to be operative to produce the fourth audio signal containing a left channel difference signal corresponding to a difference between the left channel signal contained in the first audio signal and the left channel signal reduced in its high frequency components and contained in the third audio signal and a right channel difference signal corresponding to a difference between the right channel signal contained in the first audio signal and the right channel signal reduced in its high frequency components and contained in the third audio signal.

3. An acoustic apparatus according to claim 1, wherein said attenuator means comprises a first variable attenuator by which the attenuation of the left channel signal is varied and a second variable attenuator by which the attenuation of the right channel signal is varied, said virtual left sound source position is adjusted by changing the attenuation of the left channel signal, and said virtual right sound source position is adjusted by changing the attenuation of the right channel signal.

4. An acoustic apparatus according to claim 1, wherein a cutoff frequency of the low pass filter means is selected to be not lower than 2 kHz and not higher than 6 kHz and attenuation of the first audio signal into the attenuator means is adjusted by the attenuator means that a listener who intends to listen to reproduced sound obtained from the speaker means is able to recognize a virtual sound source position in front of and at a level higher than an actual position of the speaker portion.

* * * * *